US005634415A

United States Patent [19]

Lin et al.

[11] Patent Number: 5,634,415

[45] Date of Patent: Jun. 3, 1997

[54] ADJUSTABLE RACK APPARATUS

[75] Inventors: Yun-Kung Lin; Hsiang-Huang Peng, both of Tu Cheng, Taiwan

[73] Assignee: China Textile Institute, Taipei Hsien, Taiwan

[21] Appl. No.: 636,398

[22] Filed: Apr. 23, 1996

[51] Int. Cl.[6] ..... D05B 35/00

[52] U.S. Cl. ..... 112/148; 112/470.14

[58] Field of Search ..... 112/260, 470.14, 112/311, 148, 217.1, 475.12, 475.13, 63, 470.15, 470.33; 223/61, 63, 57, 39; 38/12, 42

[56] References Cited

U.S. PATENT DOCUMENTS

| | | | |
|---|---|---|---|
| 2,556,049 | 6/1951 | Stout | 223/39 |
| 4,807,376 | 2/1989 | Kamata | 38/42 |
| 5,014,634 | 5/1991 | Hodges et al. | 112/475.12 |
| 5,417,174 | 5/1995 | Allison et al. | 112/475.13 X |
| 5,531,590 | 5/1996 | Allison et al. | 112/475.13 X |
| 5,542,199 | 8/1996 | Dreisbach et al. | 38/12 |

*Primary Examiner*—Ismael Izaguirre

*Attorney, Agent, or Firm*—Morton J. Rosenberg; David I. Klein

[57] ABSTRACT

An adjustable rack apparatus for holding work pieces of a sewing machine is provided. The adjustable rack apparatus is installed on one side of a sewing machine's work platform. The apparatus comprises a rack base assembly to which are coupled a clamp mechanism, a work piece capture mechanism, and a pallet assembly, the height of which relative to the rack base assembly may be readily adjusted. The adjustable rack apparatus is preferably employed to support and hold a stack of trouser pieces before, during, and after a sewing operation sequentially performed thereon. The order of the trouser pieces in the given stack is thereby preserved, and the efficiency of the overall manufacturing operation is enhanced.

2 Claims, 2 Drawing Sheets

ADJUSTABLE RACK APPARATUS

BACKGROUND OF THE INVENTION

1. Field of the Invention

The present invention is related to a novel adjustable rack apparatus. More specifically, the present invention is directed to a device for use in sewing trouser pieces, being affixed during use on one side of the work platform of a sewing machine to hold a stacked plurality of material while one or more of them are being sewn. The adjustability provided by the subject rack apparatus is superior to that of any such apparatus known in the prior art, making easier the given sewing task.

2. Description of the Prior Art

Sewing machines are widely used in the sewing and finishing of various parts of all kinds of garments, parts such as trouser hems, shirt collars and cuffs, etc. in sewing plants, as in most manufacturing plants, efficiency in production is of paramount importance. Thus, the suitability and convenience of sewing machine use to each sewing machine operator are important factors. In the sewing of trouser pieces, the trouser pieces to be sequentially sewn are generally stacked for storage and transfer. The trouser pieces are continually unpacked for sewing at each work station and packed again in such stacks for transfer to another working station. In a typical trouser manufacturing process, a worker fetches a bundle of trouser pieces for sewing, sews each trouser piece, then packs the sewn trouser pieces for another sewing station, the steps being repeated again and again. For optimum efficiency, it is important that these stacks of trouser pieces not be disturbed.

In practice, the sewing process is not facilitated, but actually constrained, by the typical work platform of a prior art sewing machine, largely due to its fixed configuration and plain structure. Insufficient means are provided for properly supporting the stacked trouser pieces while they are being sewn. The trouser pieces in a given stack are typically sewn piece-by-piece. Given that the work is required to be performed both rapidly and precisely, the trouser pieces are very often disordered or dropped, detrimentally affecting subsequent processes.

SUMMARY OF THE INVENTION

Accordingly, a primary object of the present invention is to provide an adjustable rack apparatus for holding work pieces while they are being sewn, particularly, to provide such an apparatus for use with a sewing machine which may be affixed on one side of the sewing machine's work platform so as to support and hold a plurality of trouser pieces, the adjustment of the apparatus being convenient to effect to make easier the given sewing operation.

Another object of the present invention is to provide an adjustable rack apparatus for sewing trouser pieces in which the space between the sewing machine and the structure of the apparatus supporting the trouser pieces may be readily adjusted so that the trouser pieces are steadily held during and after the given sewing operation, the bundle of trouser pieces being maintained in order, so as to facilitate the next process and thereby enhance the efficiency of the overall manufacturing process.

Another object of the present invention is to provide an adjustable rack apparatus for holding trouser pieces which is easy to operate.

The adjustable rack apparatus of the present invention is suited for sewing a plurality of trouser pieces at various work stations. It eases the stress and strain on workers. It does so while minimizing the space necessary for work pieces.

DESCRIPTION OF THE DRAWINGS

The present invention will become more clearly appreciated as the disclosure of the present invention is made with reference to the accompanying Drawings wherein.

DESCRIPTION OF THE PREFERRED EMBODIMENTS

Figure 1:
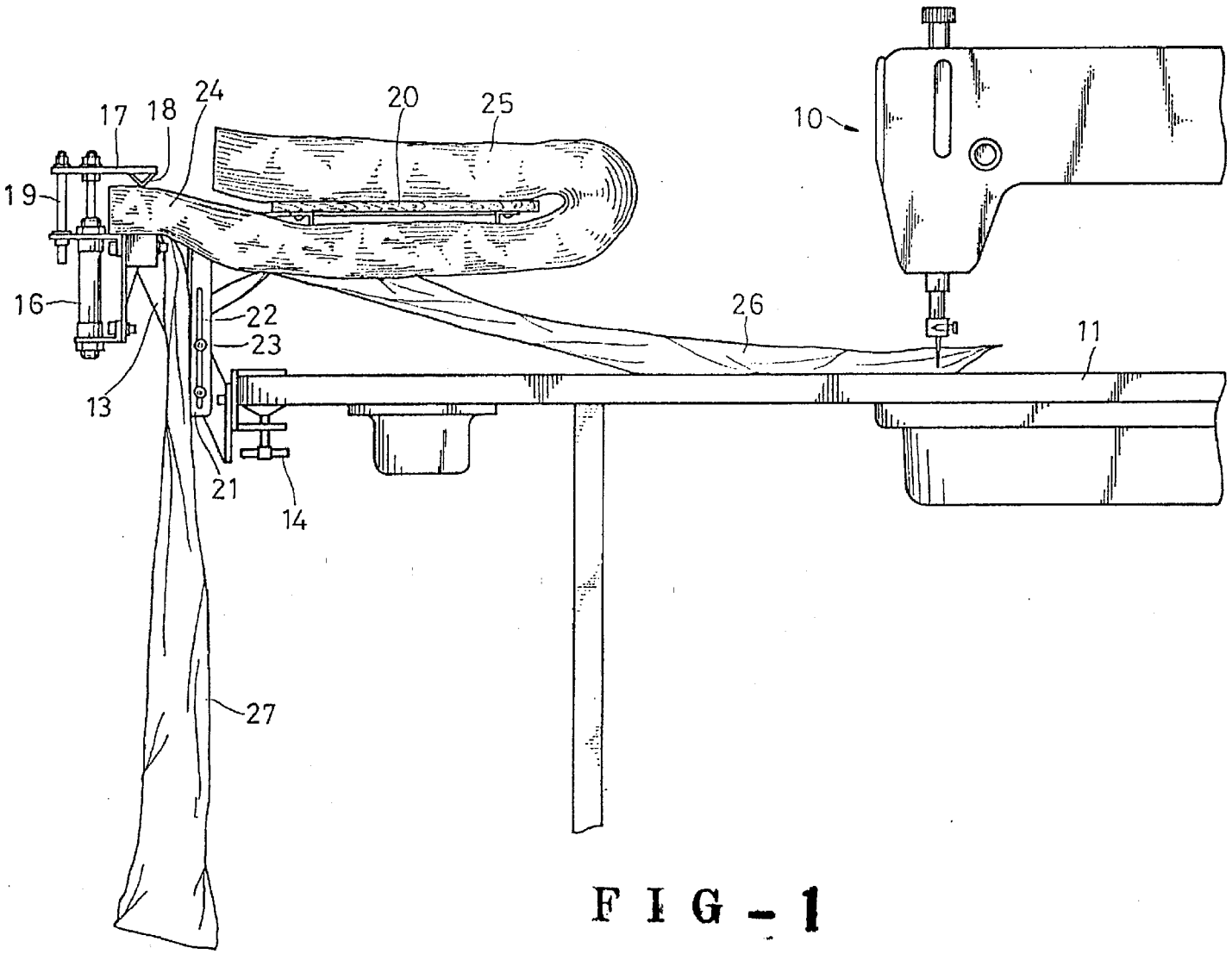
FIG. 1 is an elevational view of a preferred embodiment of the adjustable rack apparatus of the present invention; and, FIG. 2 is an exploded perspective view of the preferred embodiment of the present invention shown in FIG. 1.
Figure 2:
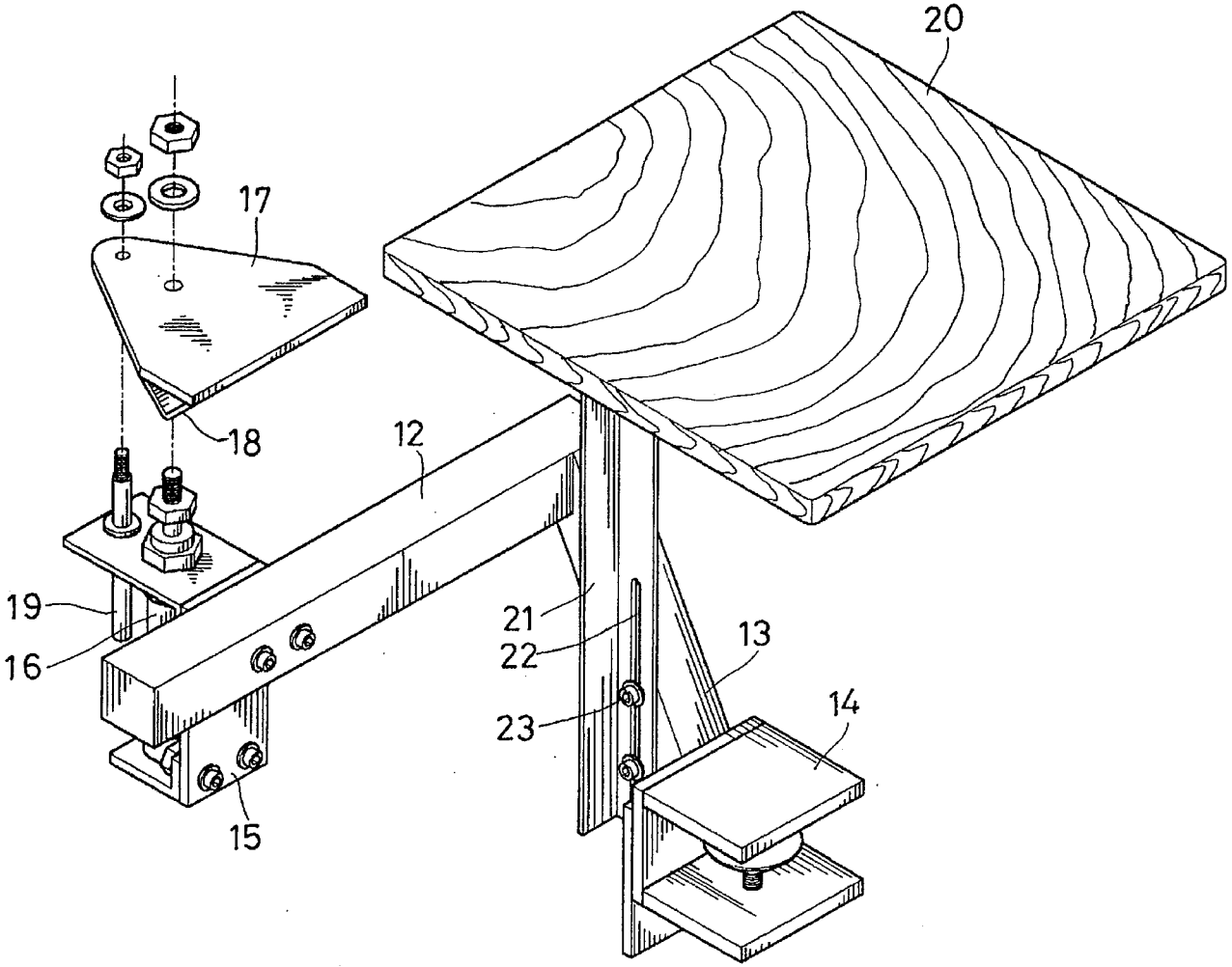

Referring to FIGS. 1 and 2, there is shown a preferred embodiment of the subject adjustable rack apparatus installed on one side of a work platform 11 of a sewing machine 10. The adjustable rack apparatus comprises a rack base assembly having a rack base member 12. The rack base assembly is coupled to a work piece capturing mechanism, a C-clamp structure, and a pallet assembly having a pallet 20, the height of which may be adjusted.

The rack base assembly includes a transversal rack base member 12 and a slant base member 13 extending downward from the front side of the rack base member 12. A C-clamp structure 14 is connected to the slant base member 13, as shown in FIG. 1, to securely clamp to one side of the work platform 11 in an easily detachable manner.

The work piece capture mechanism includes a generally C-shaped stationary member 15 mounted to a rear end portion of the rack base member 12 with suitable screw fasteners. The C-shaped member 15 has its open side directed away from rack base member 12 and has installed therethrough a cylinder 16 and a sliding bar 19, both of which are connected to a pressure plate 17. On the bottom of a front edge portion of the pressure plate 17 is installed a hold down strip 18.

The cylinder 16 biases the pressure plate 17 to move downward toward the rack base member 12, while the sliding bar 19 guides the movements of the pressure plate 17 upward and downward. The hold down strip 18 and the top surface of the rack base member 12 then form clamping surfaces for holding a stack of trouser pieces in place.

The pallet 20 is planar in shape and is supported by a support frame 21 extending vertically therefrom. A sliding groove is formed in the support frame 21 so that two locking screw bars 23 may be passed therethrough to engage the slant base member 13 of the rack base assembly, thus enabling the pallet 20 to be securely maintained in an adjustable manner above the rack base member 12 to form a reconfigurable support surface for a portion of the stacked trouser pieces. The height of the pallet 20 may be adjusted to suit the various specifications of the given stack of trouser pieces by untightening the screw bars 23, adjusting the pallet assembly's position, then retightening the screw bars 23.

As shown FIG. 1, when the subject adjustable rack apparatus is mounted to the work platform of a sewing machine, the holding mechanism formed by the hold down strip of the pressure plate 17 and the rack base member 12 captures the end 24 of the stacked trouser pieces. The distal end 25 of the trouser piece stack is steadily supported by the pallet 20. The operator of the sewing machine may then fetch in turn from the stack the trouser pieces 26 for sewing.

The sewn trouser pieces are kept in order through this process. Thus, the given sewing operation is simplified, and the scattering of the trouser pieces is avoided, such that production efficiency is enhanced.

Therefore, as described herein, the subject adjustable rack apparatus is simple, yet uniquely enables stacked trouser pieces to be securely supported and held before, during, and after a given sewing operation performed thereon. Hence, the overall utility of the sewing machine to which the apparatus is mounted is vastly increased.

It should be understood that the embodiment described herein is merely exemplary and that a person skilled in the art may make many variations and modifications without departing from the spirit and the scope of the present invention. All such modifications are intended to be included within the scope of the invention as defined in the appended claims.

What is claimed is:

1. An adjustable rack apparatus for securely supporting a stacked plurality of workpieces adjacent a sewing machine comprising:

(a) a rack base assembly having first and second elongate rack base members, said first rack base member extending in a horizontal direction between distal first and second portions thereof, said second rack base member transversally extending horizontally and vertically from said first portion of said rack base member;

(b) workpiece capture means coupled to said rack base assembly for releasably capturing said stacked workpieces against said first rack base member, said workpiece capture means including a displaceable pressure plate member opposing at least a portion of said first rack base member, said pressure plate member being biased toward engagement with said portion of said first rack base member, said pressure plate member having a hold down strip projecting therefrom toward said first rack base member for securely engaging said stacked workpieces;

(c) a pallet assembly adjustably coupled to said rack base assembly, said pallet assembly having a substantially planar pallet member and a pallet support frame member extending substantially vertically therefrom, said pallet support frame being releasably mounted to said second rack base member; and, (d) clamp means coupled to said rack base assembly for releasably mounting said rack base assembly to a work platform of said sewing machine.

2. An adjustable rack apparatus for securely supporting a stacked plurality of workpieces adjacent a sewing machine comprising:

(a) a rack base assembly having first and second elongate rack base members, said first rack base member extending in a horizontal direction between distal first and second portions thereof, said second rack base member transversally extending horizontally and vertically from said first portion of said rack base member;

(b) workpiece capture means coupled to said rack base assembly for releasably capturing said stacked workpieces against said first rack base member, said workpiece capture means including a stationary frame member and a pressure plate member displaceably coupled thereto by a slide bar and a cylinder, said slide bar being adapted to guide said displacement of said pressure plate member, said cylinder biasing said pressure plate member toward said first rack base member, said pressure plate member having a hold down strip projecting therefrom toward said first rack base member;

(c) a pallet assembly adjustably coupled to said rack base assembly, said pallet assembly having a substantially planar pallet member and a pallet support frame member extending substantially vertically therefrom, said pallet support frame member having formed therethrough an elongate adjustment slot;

(d) fastening means passing through a portion of said elongate adjustment slot of said pallet support frame member for releasably fastening said pallet support frame member to said second rack base member; and, (e) clamp means coupled to said rack base assembly for securely mounting said rack base assembly to a work platform of said sewing machine.

* * * * *